US005922523A

United States Patent [19]

Helber et al.

[11] Patent Number: 5,922,523

[45] Date of Patent: Jul. 13, 1999

[54] FILTER DYES FOR PHOTOGRAPHIC ELEMENTS

[75] Inventors: Margaret Jones Helber, Rochester, N.Y.; William James Harrison, Herts, United Kingdom; Elizabeth Ann Gallo, Rochester, N.Y.

[73] Assignee: Eastman Kodak Company, Rochester, N.Y.

[21] Appl. No.: 08/565,460

[22] Filed: Nov. 30, 1995

[51] Int. Cl.[6] ..... G03C 1/83

[52] U.S. Cl. ..... 430/513; 430/522

[58] Field of Search ..... 430/513, 522, 430/559

[56] References Cited

U.S. PATENT DOCUMENTS

| | | | |
|---|---|---|---|
| 3,247,127 | 4/1966 | Bailey | 430/522 |
| 3,440,051 | 4/1969 | Bailey | 430/522 |
| 3,468,883 | 9/1969 | Bailey | 430/522 |
| 3,653,905 | 4/1972 | Depoorter et al. | 430/522 |
| 4,042,397 | 8/1977 | Moelants et al. | 430/522 |
| 4,078,933 | 3/1978 | Sugiyama et al. | 430/522 |
| 4,770,984 | 9/1988 | Ailliet et al. | 430/505 |
| 5,274,109 | 12/1993 | Texter | 430/365.4 |
| 5,326,687 | 7/1994 | Texter | 430/522 |
| 5,459,265 | 10/1995 | Wariishi et al. | 544/300 |

FOREIGN PATENT DOCUMENTS

| | | | |
|---|---|---|---|
| 0 554 834 | 8/1993 | European Pat. Off. | C09B 67/00 |
| 0 594 973 | 5/1994 | European Pat. Off. | G03C 1/005 |
| 6-332112 | 12/1994 | Japan | G03C 1/83 |
| 7-102179 | 4/1995 | Japan | G09B 23/08 |
| 93/23792 | 11/1993 | WIPO | G03C 1/005 |

*Primary Examiner*—Janet C. Baxter
*Attorney, Agent, or Firm*—Edith A. Rice

[57] ABSTRACT

A photographic element contains a filter dye of the Formula (I):

(I)

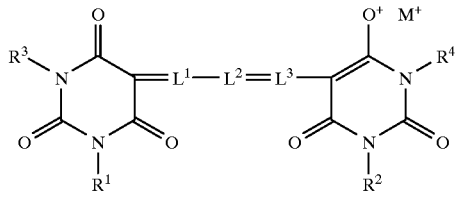

wherein $R^1$–$R^4$ each independently represent a substituted or unsubstituted alkyl group, a substituted or unsubstituted aryl group or a substituted or unsubstituted heteroaryl group; $L^1$, $L^2$ and $L^3$ each independently represent substituted or unsubstituted methine groups; $M^+$ represents a proton or an inorganic or organic cation.

5 Claims, No Drawings

FILTER DYES FOR PHOTOGRAPHIC ELEMENTS

FIELD OF THE INVENTION

This invention relates to a photographic element containing a trimethine filter dye.

BACKGROUND OF THE INVENTION

Photographic materials may utilize filter dyes for a variety of purposes. Filter dyes may be used to adjust the speed of a radiation-sensitive layer; they may be used as absorber dyes to increase image sharpness of a radiation-sensitive layer; they may be used as antihalation dyes to reduce halation; they may be used reduce the amount or intensity of radiation from reaching one or more radiation-sensitive layers, and they may also be used to prevent radiation of a specific wavelength or range of wavelengths from reaching one or more of the radiation-sensitive layers in a photographic element. For each of these uses, the filter dye(s) may be located in any number of layers of a photographic element, depending on the specific requirements of the element and the dye, and on the manner in which the element is to be exposed. The amount of filter dyes used varies widely, but they are preferably present in amounts sufficient to alter in some way the photographic response of the element. Filter dyes may be located in a layer above a radiation-sensitive layer, in a radiation-sensitive layer, below a radiation-sensitive layer, or in a layer on the opposite side of the support from a radiation-sensitive layer.

Photographic materials often contain layers sensitized to different regions of the spectrum, such as red, blue, green, ultraviolet, infrared, X-ray, to name a few. A typical color photographic element contains a layer sensitized to each of the the three primary regions of the visible spectrum, i.e., blue, green, and red. Silver halide used in these materials has an intrinsic sensitivity to blue light. Increased sensitivity to blue light, along with sensitivity to green light or red light, is imparted through the use of various sensitizing dyes adsorbed to the silver halide grains. Sensitized silver halide retains its intrinsic sensitivity to blue light.

There are numerous applications for which filtration or absorbance of very specific regions of light are highly desirable. Some of these applications, such as yellow filter dyes and magenta trimmer dyes, require non-diffusing dyes which may be coated in a layer specific manner to prevent specific wavelengths of light from reaching specific layers of the film during exposure. These dyes must have sharp-cutting bathochromic absorbance features on the bathochromic side to prevent light punch through without adversely affecting the speed of the underlying emulsions. Preferably these dyes should exhibit high extinction coefficients, and sharp-cutting bathochromic absorption edges when incorporated into photographic elements. Typically, to achieve these properties, solutions of dissolved, monomeric dyes have been incorporated. Dyes introduced by this method cannot be coated in a layer specific manner without the use of mordants, and therefore they often wander into adjacent layers and can cause problems such as speed loss or stain. Solubilized monomeric dyes may be mordanted to prevent wandering through adjacent layers. While the use of polymeric mordants can prevent dye wandering, such mordants aggravate the stain problem encountered when the dye remains in the element through processing.

Just as yellow filter dyes prevent false color rendition from the exposure of emulsions sensitized to a region of the spectrum other than blue filter dyes absorbing in the UV, magenta, cyan and infrared regions can prevent false color rendition by shielding sensitized emulsion layers from exposure to specific wavelength regions. One application of this strategy is the use of green-absorbing magenta trimmer dyes. In one type of typical color photographic element containing a layer sensitized to each of the three primary regions of the visible spectrum, i.e., blue, green, and red, the green-sensitized layer is coated above the red-sensitized layer and below the blue-sensitized layer. Depending on the chosen spectral sensitivity maxima for the sensitized silver halide layers, there may be a region of overlap between the spectral sensitivities of the green and red emulsions. Under such circumstances, green light which is not absorbed by the green-sensitive emulsion can punch through to the red sensitive emulsion and be absorbed by the leading edge of the red spectral sensitizing dye. This crosstalk between the green and red emulsions results in false color rendition. It would, therefore, be highly desirable to find a green-absorbing filter dye which upon incorporation into a photographic element would absorb strongly around the spectral maximum of the green-sensitized emulsion, and possess a sharp cutting bathochromic absorbance such that there is no appreciable absorbance just bathochromic to its absorbance maximum. Though the position of optimal absorption maximum for a magenta trimmer dye will vary depending on the photographic element being constructed, it is particularly desirable in one type of typical color photographic element containing a layer sensitized to each of the three primary regions of the visible spectrum, i.e., blue, green, and red, that a magenta trimmer dye absorb strongly at about 550 nm, and possess a sharp cutting bathochromic absorbance such that there is no appreciable absorbance above about 550 nm. Therefore it would be desirable to provide a filter dye for use in photographic elements that possesses high requisite absorbance in the green region of the spectrum below about 550 nm, but little or no absorbance above about 550 nm, and furthermore does not suffer from incubative or post process stain problems, and furthermore is not prone to migration in the coated film, but is fully removed upon processing.

One method used to incorporate soluble monomeric filter dyes into photographic film element layers is to add them as aqueous or alcoholic solutions. Dyes introduced by this method are generally highly mobile and rapidly diffusing and often wander into other layers of the element, usually with deleterious results. While the use of polymeric mordants can prevent dye wandering, such mordants aggravate the stain problem encountered when the dye remains in the element through processing.

Many filter dyes, of various hues, for use in photographic elements suffer from stain problems. Some dyes are not fully decolorized or removed during photographic processing, thus causing post processing stain. Filter dyes incorporated as latex dispersions are especially prone to post-process stain problems. Other dyes wander into other layers of the element, adversely affecting image quality. Dyes immobilized with cationic mordants are especially prone to wandering within the photographic element. Still other dyes react before exposure with other components of the photographic element, such as color couplers, thus causing incubative stain.

Green-absorbing filter dyes are also useful as antihalation dyes and as anticrossover dyes in X-ray films sensitive to green-emitting phosphors. A description of green absorbing anticrossover dyes for radiographic elements appears in U.S. Pat. Nos. 4,900,652 and 4,803,150.

Green-absorbing filter dyes incorporated as microcrystalline dye dispersions have been developed to address some of the problems of dye wandering and stain. U.S. Pat. Nos. 4,950,586; 4,948,717; 4,940,654; 4,923,788; 4,900,653; 4,803,150; 4,994,356; 5,098,820; 5,260,179; 5,283,165; 5,399,690; 4,861,700; 4,857,446; 4,855,221; 5,213,956; 5,213,957 and EP 430,186 disclose the use of various dyes in solid particle dispersions. However, in general, these dyes are broad and often exhibit unwanted absorption in the red region of the spectrum. The exact range of desirable absorbance for a green-absorbing filter dye can vary depending on the photographic element being designed for use. However, in one type of typical color photographic element in which a filter dye will be coated above a red-sensitive layer, it is desirable for the dye to exhibit high absorbance in green region of the spectrum below around 550 nm, and possess a sharp cutting bathochromic absorbance such that there is no appreciable absorbance past 550 nm. Many green-absorbing microcrystalline dyes which do not absorb in the red region of the spectrum are too hypsochromic to provide adequate absorption in the longer wavelengths of the green region.

PROBLEM TO BE SOLVED BY THE INVENTION

Therefore it would be desirable to provide a filter dye for use in photographic elements that possesses high requisite absorbance in the green region of the spectrum below around 550 nm, but little or no absorbance past 550 nm, and furthermore does not suffer from incubative or post process stain problems, and furthermore is not prone to migration in the coated film, but is fully removed upon processing.

SUMMARY OF THE INVENTION

One object of the invention is to provide a silver halide radiation-sensitive material containing at least one dye, incorporated in a hydrophilic colloid layer, which is decolorized irreversibly by photographic processing and which causes no deleterious effects on the photographic emulsions before or after processing.

Another object of the invention is to provide a silver halide radiation-sensitive material in which a single, selected hydrophilic colloid layer is dyed and exhibits excellent decolorizing properties upon photographic processing.

Another object is to provide a silver halide radiation-sensitive material in which a single, selected hydrophilic colloid layer is dyed and exhibits high absorbance in a portion of the blue spectral region just below 550 nm, but possesses comparatively little absorbance past 550 nm.

One aspect of this invention comprises a photographic element containing a filter dye of Formula (I):

(I)

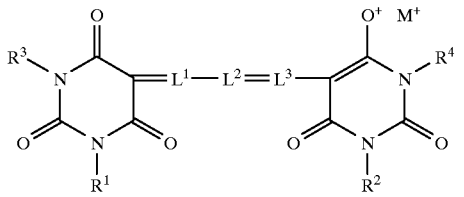

wherein $R^1$–$R^4$ each independently represent a substituted or unsubstituted alkyl group, a substituted or unsubstituted aryl group or a substituent selected from the group consisting of hydrogen, halogen, cyano, amino, alkoxy, alkoxycarbonyl, amido, acyl, alkylamino, carboxy, sulfonamido, sulfamoyl and hydroxy; $L^1$, $L^2$ and $L^3$ each independently represent substituted or unsubstituted methine groups; $M^+$ represents a proton or an inorganic or organic cation.

ADVANTAGEOUS EFFECT OF THE INVENTION

A particular advantage of the dyes of the invention is that they provide higher covering power at their coated $\lambda_{max}$ than comparable known solid particle dyes. This advantage is particularly important in modern film formats and processing conditions, as filter dyes with high covering power need not be coated at as high a coverage as dyes with lower covering power to in order to achieve the same degree of light filtration. In addition to reducing manufacturing costs, lower levels of coated dyes will reduce the level of organic dye built up in the processing solutions, and the resulting lower levels of dissolved dyes removed from photographic elements will have reduced environmental impact.

DETAILED DESCRIPTION OF THE INVENTION

The photographic element containing a filter dye of Formula (I):

(I)

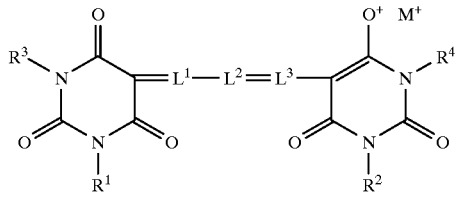

wherein $R^1$–$R^4$ each independently represent a substituted or unsubstituted alkyl group, a substituted or unsubstituted aryl group or a substituent selected from the group consisting of hydrogen, halogen, cyano, amino, alkoxy, alkoxycarbonyl, amido, acyl, alkylamino, carboxy, sulfonamido, sulfamoyl and hydroxy; $L^1$, $L^2$ and $L^3$ each independently represent substituted or unsubstituted methine groups; $M^+$ represents a proton or an inorganic or organic cation.

In the dyes of Formula (I), illustrative alkyl groups preferably contain 1 to 6 carbon atoms and include methyl, ethyl, n-propyl, isopropyl, n-butyl, t-butyl, n-hexyl, and isohexyl. Examples of aryl groups include phenyl, naphthyl, anthracenyl, and styryl. Examples of substituted aryl groups include, for example, tolyl, m-chlorophenyl and p-methanesulfonylphenyl, etc. Examples of heteroaryl groups include pyridyl, thienyl, furyl, and pyrrolyl. Examples of acyl groups include ethoxycarbonyl, amido, benzoyl, carboxy and acetyl.

When reference in this application is made to a substituent "group", this means that the substituent may itself be substituted or unsubstituted (for example "alkyl group" refers to an unsubstituted or substituted alkyl). Generally, unless otherwise specifically stated, substituents on any "groups" referenced herein or where something is stated to be possibly substituted, include the possibility of any groups, whether substituted or unsubstituted, which do not destroy properties necessary for the photographic utility. It will also be understood throughout this application that reference to a compound of a particular general formula includes those compounds of other more specific formula which specific formula falls within the general formula definition.

Examples of substituents on any of the mentioned groups can include known substituents, such as: halogen, for example, chloro, fluoro, bromo, iodo; alkoxy, particularly those with 1 to 6 carbon atoms (for example, methoxy, ethoxy); substituted or unsubstituted alkyl, particularly lower alkyl (for example, methyl, trifluoromethyl); alkenyl or thioalkyl (for example, methylthio or ethylthio), particularly either of those with 1 to 6 carbon atoms; substituted and unsubstituted aryl, particularly those having from 6 to 20 carbon atoms (for example, phenyl, naphthyl, anthracenyl or styryl); and substituted or unsubstituted heteroaryl, particularly those having a 5 or 6-membered ring containing 1 to 3 heteroatoms selected from N, O or S (for example, pyridyl, thienyl, furyl, pyrrolyl); and others known in the art. Alkyl substituents may specifically include "lower alkyl", that is having from 1 to 6 carbon atoms, for example, methyl, ethyl, and the like. Further, with regard to any alkyl group, alkylene group or alkenyl group, it will be understood that these can be branched or unbranched and include ring structures.

In the dyes of Formula (I), each of $L^1$, $L^2$ and $L^3$ independently represents an unsubstituted methine group or methine group substituted with an alkyl group containing 1 to 6 carbon atoms, or an aryl group. M is preferably H, Na, K, triethyl ammonium or pyridinium.

Solid particle dispersions of the dye of Formula (I) are useful as general purpose filter dyes, alone or in combination with other filter dyes in photographic elements. They are insoluble at coating pH's of 6 or less (generally 4–6) and soluble at processing pH's of 8 or more (generally 8–12), so that they do not interact with other components of the photographic element, yet are still fully solubilized during photographic processing.

An advantage of dyes of the invention is that they generally possess absorbance envelopes that are sharper cutting on the bathochromic side than comparable known solid particle dispersion dyes. This feature is especially advantageous when strong light absorbance is required in a spectral region up to a specific $\lambda_{max}$, and maximum light transmission is required past the specified $\lambda_{max}$. Such filter or trimmer dyes are especially useful when coated in specific layers of color photographic films to effectively prevent light of a specific wavelength region from exposing radiation-sensitive layers below the light filtration layer containing the dye, without causing unwanted absorption of longer wavelength radiation. A magenta filter dye coated directly above a red-sensitive silver halide layer is a particularly advantageous example of such absorbance features, and excellent green/red speed separation can be realized. In a typical color photographic element, it is desirable to have a green-absorbing filter dye which when coated absorbs strongly at wavelengths close to 550 nm, but which absorbs comparatively little at wavelengths greater than 550 nm. It should be emphasized that the exact envelope of desirable light absorbance for a filter dye, even specifically a green filter dye, varies tremendously from one photographic element to another depending on the intended purpose of the material. Some photographic elements might require a filter dye, such as a green filter dye, which absorbs strongly up to a wavelength somewhat shorter or longer than 550 nm, but is sharp cutting on the bathochromic side, mostly transmitting wavelengths of light past the desired absorbance $\lambda_{max}$. The feature of coated dye absorbance exhibiting a sharp cutting bathochromic characteristic is fundamentally useful for wavelength-specific light filtration, though the exact wavelength of desired spectral shift from absorbance to transmission may be different for different photographic materials.

The dyes of Formula (I) may be incorporated into the photographic element in any of the ways known in the art, but preferably as a dispersion of microcrystalline dye.

In a preferred/another embodiment, the objectives and advantages of the invention are met by radiation-sensitive photographic elements wherein the dye according to Formula (I) has Formula (II):

(II)

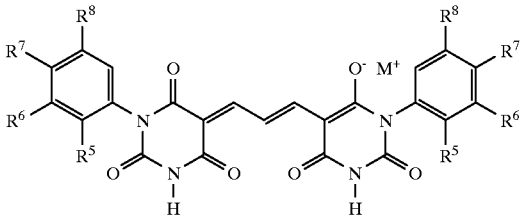

wherein $R^5$–$R^8$ each independently represent a substituted or unsubstituted alkyl group, a substituted or unsubstituted aryl group or a substituent selected from the group consisting of hydrogen, halogen, cyano, amino, alkoxy, alkoxycarbonyl, amido, acyl, alkylamino, carboxy, sulfonamido, sulfamoyl and hydroxy.

Examples of compounds of Formula (I) and II are:

TABLE I

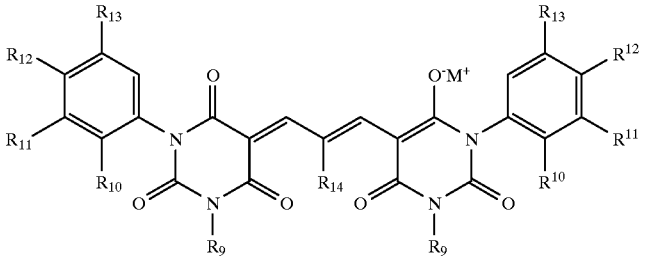

| | $R^9$ | $R^{10}$ | $R^{11}$ | $R^{12}$ | $R^{13}$ | $R^{14}$ | $M^+$ |
|---|---|---|---|---|---|---|---|
| 1 | H | H | H | Me | H | H | H |
| 2 | H | H | H | C1 | H | H | H |
| 3 | H | H | CN | CN | H | H | H |
| 4 | H | H | H | $CONH_2$ | H | H | H |
| 5 | H | H | H | Me | H | Me | TEAH |

TABLE I-continued

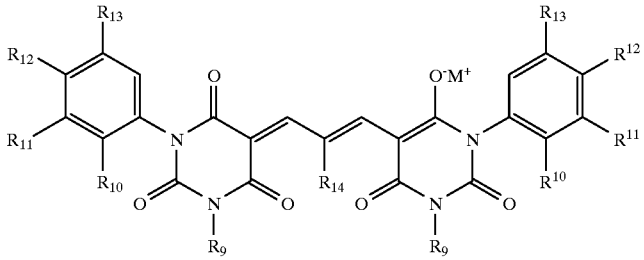

| | $R^9$ | $R^{10}$ | $R^{11}$ | $R^{12}$ | $R^{13}$ | $R^{14}$ | $M^+$ |
|---|---|---|---|---|---|---|---|
| 6 | H | H | H | H | H | H | TEAH |
| 7 | H | H | H | OMe | H | H | TEAH |
| 8 | H | H | H | COOH | H | H | H |
| 9 | H | $NHSO_2Me$ | H | H | H | H | TEAH |
| 10 | H | H | OMe | H | H | H | H |
| 11 | H | H | CN | CN | H | H | H |
| 12 | H | H | Cl | H | H | H | TEAH |
| 13 | H | H | COOH | H | H | H | H |
| 14 | H | H | COOH | H | COOH | H | TEAH |
| 15 | H | H | Me | Me | H | H | TEAH |
| 16 | H | Me | OH | H | H | H | TEAH |
| 17 | H | H | Cl | OH | C1 | H | TEAH |
| 18 | H | Cl | H | H | H | H | TEAH |
| 19 | Et | H | OMe | OMe | H | H | Pyr |
| 20 | Et | H | H | COOH | H | H | TEAH |
| 21 | H | H | OMe | H | OMe | H | TEAH |
| 22 | H | CN | H | H | H | H | TEAH |
| 23 | H | H | H | H | H | Me | Pyr |
| 24 | H | H | H | NO | H | H | Na |
| 25 | H | H | H | NHAc | H | H | TEAH |

The dyes of Formulae (I) and (II) and (III) can be prepared by synthetic techniques well-known in the art, as illustrated by the synthethesis of Compounds 1 and 2, below. Such techniques are further illustrated, for example, in "*The Cyanine Dyes and Related Compounds*", Frances Hamer, Interscience Publishers, 1964.

Synthesis of Compound 1

A solution of N-(4-methylphenyl)barbituric acid (10.0 grams) in pyridine (150 mL) was heated to reflux and treated with trimethoxypropene (6.1 grams) and acetonitrile (50 mL). After stirring for 15 minutes, the slurry was filtered and a solid isolated. This solid was slurried for 15 minutes in a solution of 15% w/w concentrated hydrochloric acid in methanol (350 mL). The slurry was filtered to provide Compound 1 (8.0 grams).

Synthesis of Compound 2

A solution of N-(4-chlorophenyl)barbituric acid (10.0 grams) in pyridine (150 mL) was heated to reflux and treated with trimethoxypropene (5.5 grams) and acetonitrile (50 mL). After stirring for 15 minutes, the slurry was filtered and a solid isolated. This solid was reluxed for 5 minutes in MeOH (400 mL); concentrated hydrochloric acid (50 mL) was then added and solution was refluxed for 0.5 hour. The slurry was filtered to provide Compound 2 (8.0 grams).

The photographic element of this invention comprises a support bearing at least one light sensitive hydrophilic colloid layer and at least one non-light sensitive hydrophilic colloid layer. A dye of Formula (I) may be incorporated in a hydrophilic layer of the photographic element in any known way.

The support of the element of the invention can be any of a number of well-known supports for photographic elements as discussed more fully below.

The photographic elements made by the method of the present invention can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support).

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. Nos. 4,279,945 and 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure*, September 1994, Number 365, Item 36544, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of internal latent image forming emulsions (that are either fogged in the element or fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. Nos. 4,163,669; 4,865,956; and 4,923,784 are particularly useful. Also contemplated is the use of nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) formulated either as oil-in-water dispersions, latex dispersions, solid particle dispersions, or as direct gelatin dispersions. Additionally, they may be used with "smearing" couplers (e.g. as described in U.S. Pat. No. 4,366,237; EP 096 570; U.S. Pat. Nos. 4,420,556; and 4,543,323.) Also, the couplers may be blocked or coated in protected form as described, for example, in Japanese Application 61/258,249 or U.S. Pat. No. 5,019,492.

The photographic elements may further contain other image-modifying compounds such as "Developer Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. Nos. 4,346,165; 4,540,653 and 4,906,559); with ballasted chelating agents such as those in U.S. Pat. No. 4,994,359 to reduce sensitivity to polyvalent cations such as calcium; and with stain reducing compounds such as described in U.S. Pat. Nos. 5,068,171 and 5,096,805. Other compounds useful in the elements of the invention are disclosed in Japanese Published Applications 83-09,959; 83-62,586; 90-072,629, 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements may be silver iodobromide, silver bromide, silver chloride, silver chlorobromide, silver chloroiodobromide, and the like. For example, the silver halide used in the photographic elements of the present invention may contain at least 90% silver chloride or more (for example, at least 95%, 98%, 99% or 100% silver chloride). In the case of such high chloride silver halide emulsions, some silver bromide may be present but typically substantially no silver iodide. Substantially no silver iodide means the iodide concentration would be no more than 1%, and preferably less than 0.5 or 0.1%. In particular, in such a case the possibility is also contemplated that the silver chloride could be treated with a bromide source to increase its sensitivity, although the bulk concentration of bromide in the resulting emulsion will typically be no more than about 2 to 2.5% and preferably between about 0.6 to 1.2% (the remainder being silver chloride). The foregoing % figures are mole %.

The type of silver halide grains preferably include polymorphic, cubic, and octahedral. The grain size of the silver halide may have any distribution known to be useful in photographic compositions, and may be either polydipersed or monodispersed.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers ($\mu$m). The tabular grains can be of any thickness compatible with achieving an aim average aspect ratio and/or average tabularity of the tabular grain emulsion. Preferably the tabular grains satisfying projected area requirements are those having thicknesses of <0.3 $\mu$m, thin (<0.2 $\mu$m) tabular grains being specifically preferred and ultrathin (<0.07 $\mu$m) tabular grains being contemplated for maximum tabular grain performance enhancements. When the native blue absorption of iodohalide tabular grains is relied upon for blue speed, thicker tabular grains, typically up to 0.5 $\mu$m in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I*, Section I.B.(3) (page 503).

The silver halide grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30 to 80° C., as described in *Research Disclosure I*, Section IV (pages 510–511) and the references cited therein.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in T. H. James, editor, *The Theory of the Photographic Process,* 4th Edition, Macmillan, New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying.

EVALUATION EXAMPLES

Example 1

Process Removability of Dyes

Dyes 1–4 of Table I were prepared as solid particle dispersions by ballmilling according to the following procedure. Water (21.7 mL) and a 6.7% solution of Triton TX-200, an alkyl aryl polyether sulfonate surfactant available from Rohm and Haas, (2.65 g) were placed in a 60 mL screw-capped bottle. A 1.0 g sample of dye was added to this solution. Zirconium oxide beads (40 mL, 2 mm diameter) were added and the container with the cap tightly secured was placed in a mill and the contents milled for four days. The container was removed and the contents added to a 12.5% aqueous gelatin (8.0 g) solution at 45° C. The new mixture was placed on a roller mill for 10 minutes and the resulting mixture was filtered to remove the zirconium oxide beads. The resulting dye dispersion had a particle size mean diameter less than 1.0 mm.

The solid particle dispersions of these dyes were coated on a polyester support according to the following procedure. A spreading agent (Olin 10G, an isononylphenoxy glycidol surfactand available from Olin Corp.) and a hardener (bis (vinylsulfonylmethyl)ether) were added to the dye-gelatin melt prepared as described above. A melt from this mixture was then coated on a poly(ethylene terephthalate) support to achieve a dye coverage of 0.13 g/m$^2$, a gelatin coverage of 1.61 g/m$^2$, and a hardener level of 0.016 g/m$^2$. The absorbance of the dye dispersion was measured with a spectrophotometer. Identical elements were subjected to Kodak E-6" Processing (which is described in *British Journal of Photography Annual,* 1977, pp.194–97) and the absorbance was measured for each. The results are shown in Table II.

TABLE II

| Dye | $D_{max}$ at $\lambda_{max}$ | $D_{max}$ after E-6 Processing |
|---|---|---|
| 1 | 1.53 | 0.01 |
| 2 | 1.99 | 0.01 |
| 3 | 1.42 | 0.01 |
| 4 | 1.18 | 0.01 |

These results show that the dyes of formulae (I) and (II) are fully solubilized for removal and/or decolorization during photographic processing.

Example 2

Spectral Shape of Solid Particle Dyes

Solid particle dispersions of Dyes 1–4 and comparative Dye A were prepared and coated on a polyester support in a manner similar to that described in Example 1. The absorbance of the dye dispersions were measured with a spectrophotometer, and a ratio of each dye's optical density (O.D.) at 550 nm and 570 nm (i.e O.D at 550 nm/O.D. at 570 nm) were calculated. A high ratio is preferable for a magenta filter dye being coated above a red-sensitive emulsion to prevent green light from reaching the red-sensitive emulsion without significantly attenuating speed past 550 nm. The following results shown in Table III were achieved:

TABLE III

Dye A

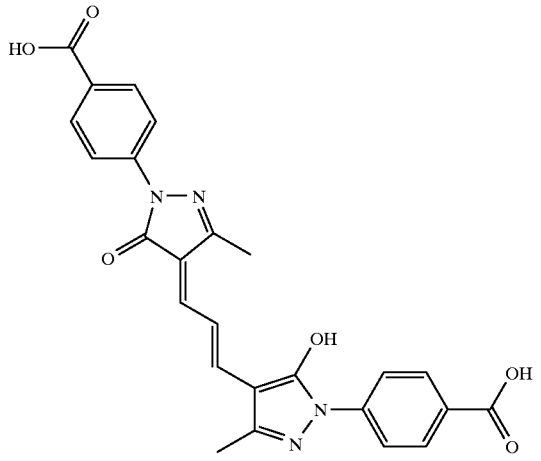

| Dye | O.D. at 550 mn/ O.D. at 570 nm |
|---|---|
| 1 | 6.1 |
| 2 | 6.0 |
| 3 | 4.7 |
| 4 | 4.4 |
| A | 1.1 |

These results demonstrate that the dyes of the invention possess superior spectral properties as solid particle dispersions for use as magenta filter dyes as compared to Dye A because they are sharp cutting near 550 nm.

The invention has been described in detail with reference to preferred embodiments thereof. It should be understood, however, that variations and modifications can be made within the spirit and scope of the invention.

What is claimed is:

1. A photographic element containing a solid particle dispersion of a dye of Formula (II):

(II)

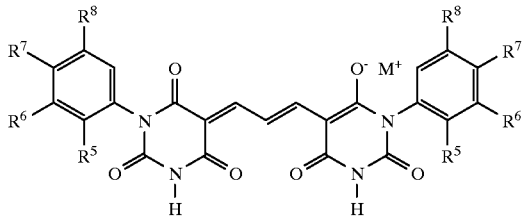

wherein $R^5$–$R^8$ each independently represent a substituted or unsubstituted alkyl group, a substituted or unsubstituted aryl group or a substituent selected from the group consisting of hydrogen, halogen, cyano, amino, alkoxy, alkoxycarbonyl, amido, acyl, alkylamino, carboxy, sulfonamido, sulfamoyl and hydroxy; and $M^+$ represents an inorganic or organic cation.

2. A photographic element according to claim 1, wherein $R^7$ is unsubstituted alkyl, halogen, cyano or amido.

3. A photographic element according to claim 1, wherein $R^7$ is methyl, chloro, cyano or amido.

4. A photographic element containing a solid particle dispersion of a filter dye of the Formula (I):

(I)

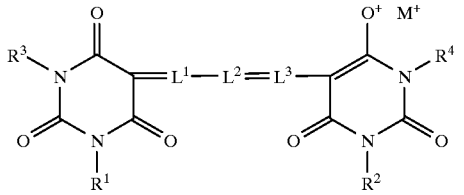

wherein $R^1$–$R^4$ each independently represent a substituted or unsubstituted alkyl group, a substituted or unsubstituted aryl group or a substituent selected from the group consisting of hydrogen, halogen, cyano, amino, alkoxy, alkoxycarbonyl, amido, acyl, alkylamino, carboxy, sulfonamido, sulfamoyl and hydroxy, with the proviso that at least one of $R^1$–$R^4$ represents an aryl group substituted with COOH, OH, $NHSO_2Me$ or NHAc; $L^1$, $L^2$ and $L^3$ each independently represent substituted or unsubstituted methine groups; $M^+$ represents a proton or an inorganic or organic cation and wherein the ratio of the optical density of the solid particle dispersion at 550 nm to the optical density of the dispersion at 570 nm is between 4.4 and 6.1.

5. A photographic element containing a solid particle dispersion of a dye of Formula (II):

(II)

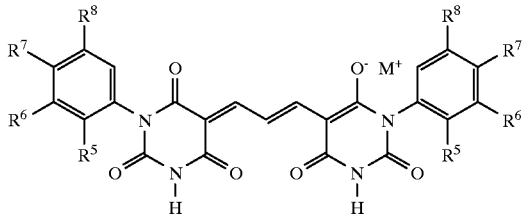

wherein $R^5$–$R^8$ each independently represent a substituted or unsubstituted alkyl group, a substituted or unsubstituted aryl group or a substituent selected from the group consisting of hydrogen, halogen, cyano, amino, alkoxy, alkoxycarbonyl, amido, acyl, alkylamino, carboxy, sulfonamido, sulfamoyl and hydroxy, with the proviso that at least one of $R^5$–$R^8$ is COOH, OH, $NHSO_2Me$ or NHAc; and $M^+$ represents a proton or an inorganic or organic cation.

* * * * *